US006427262B1

(12) United States Patent
Huang

(10) Patent No.: US 6,427,262 B1
(45) Date of Patent: Aug. 6, 2002

(54) CONNECTING DEVICE FOR FURNITURE

(76) Inventor: Yi-Chen Huang, No. 10, Min-Sheng S. Rd., Hsi Dist., Chia-Yi City (TW)

( * ) Notice: Subject to any disclaimer, the term of this patent is extended or adjusted under 35 U.S.C. 154(b) by 0 days.

(21) Appl. No.: 09/802,498

(22) Filed: Mar. 9, 2001

(51) Int. Cl.[7] ..... A47C 17/17
(52) U.S. Cl. ..... 5/37.1; 297/354.13
(58) Field of Search ..... 5/37.1, 12.1, 38, 5/47, 48; 297/354.13, 354.12, 366, 364

(56) References Cited

U.S. PATENT DOCUMENTS

| | | | | | |
|---|---|---|---|---|---|
| 4,131,960 | A | * | 1/1979 | Quakenbush | 297/342 |
| 4,654,902 | A | * | 4/1987 | Shrock et al. | 5/37.1 |
| 5,860,702 | A | * | 1/1999 | Pilarczyk et al. | 297/354.13 |
| 6,082,805 | A | * | 7/2000 | Gray et al. | 296/65.09 |
| 6,209,154 | B1 | * | 4/2001 | Huang | 297/354.13 |

* cited by examiner

*Primary Examiner*—Jack Lavinder
*Assistant Examiner*—Fredrick Conley

(74) *Attorney, Agent, or Firm*—Christie, Parker & Hale, LLP

(57) ABSTRACT

A connecting device for a sofa bed includes a first connecting member with opposite first and second end portions, and a second connecting member with a rear end portion that is pivoted to the second end portion and that is provided with a spring-loaded pawl unit. A fixed mounting plate is disposed below the first and second connecting members. A pivotable linking plate unit has an upper end pivoted to the first end portion, and a lower end pivoted to the mounting plate such that the first connecting member is movable forward and rearward relative to the mounting plate. The second connecting member is pivotable relative to the first connecting member in a first direction so as to enable the pawl unit to engage one of the ratchet teeth in order to retain the second connecting member at a certain angularposition relative to the first connecting member. The second connecting member is pivotable relative to the first connecting member in a second direction opposite to the first direction so as to enable the pawl unit to slide, past the ratchet teeth in order to dispose the front end portion of the second connecting member at a position coplanar with the first end portion of the first connecting member.

10 Claims, 7 Drawing Sheets

CONNECTING DEVICE FOR FURNITURE

BACKGROUND OF THE INVENTION

1. Field of the Invention

The present invention relates to a connecting device. for a piece of furniture, such as a sofa bed, more particularly to a connecting devrice for connecting a backrest frame and a seat frame at adjustable positions.

2. Description of the Related Art

FIG. 1 illustrates a conventional sofa bed 1 which includes left and right leg frames 11, front and rear horizontal bars 15 extending between the leg frames 11, and a seat frame 13 and a backrest frame 12 disposed on the horizontal bars 15 and between the leg frames 11. The sofa bed 1 incorporates a pair of connecting devices 2 for connecting the backrest frame 12 adjustably to the seat frame 13 such that the sofa bed 1 can serve as a bed or a sofa as desired. With further reference to FIG. 2, the connecting device 2 mainly includes a first connecting member 22 secured to the backrest frame 12, a second connecting member 23 pivoted to the first connecting member 22 and secured to the seat frame 13, a fixing plate 21 disposed below the first and second connecting members 22, 23 and attached securely to a cross-bar 111 of one of the leg frames 11, front and rear fixed support plates 24 interconnecting securely the fixing plate 21 and the second connecting member 23, a positioning piece 32 extending from the first connecting member 22 and formed with a plurality of positioning grooves 321, a holding pin 35 projecting from the second connecting member 23 for engaging one of the positioning grooves 321 so as to retain the backrest frame 12 at a folded position or an unfolded position relative to the seat frame 13, and a spring 331 for urging the positioning piece 32 against the holding pin 35. To adjust the position of the backrest frame 12, the backrest frame 12 is moved forwardly or rearwardly relative to the seat frame 13 for engaging the holding pin 35 with a selected one of the positioning grooves 321. However, since the second connecting member 23 is connected securely to the fixing plate 21, the seat frame 13 is kept stationary relative to the leg frames 11. As such, the sofa bed 1 still occupies a relatively large amount of space even when it is converted to a sofa, and is thus not satisfactory.

SUMMARY OF THE INVENTION

Therefore, an object of the present invention is to provide a connecting device for a sofa bed to enable the sofa bed to occupy less amount of space when converted to a sofa.

Another object of the present invention is to provide a sofa bed of the aforementioned type.

According to one aspect of the present invention, a connecting device is provided for use in a furniture frame having a support frame and first and second frame members disposed on the support frame. The connecting device includes a first connecting member, a second connecting member, a mounting plate and a pivotable linking plate unit. The first connecting member has a first end portion adapted to be fixed to the first frame member, and a second end portion opposite to the first end portion and formed with a plurality of ratchet teeth. The second connecting member has a front end portion adapted to be fixed to the second frame member, and a rear end portion pivoted to the second end portion of the first connecting member. The rear end portion is provided with a spring-loaded pawl unit. The mounting plate is disposed below the first and second connecting members, and is adapted to be fixes to the support frame. The linking plate unit has an upper end pivoted to the first end portion of the first connecting member, and a lower end pivoted to the mounting plate such that the first connecting member is movable forward and rearward relative to the mounting plate. The second connecting member is pivotable relative to the first connecting member in a first direction so as to enable the pawl unit to engage one of the ratchet teeth in order to retain the second connecting member at a certain angular position relative to the first connecting member. The second connecting member is pivotable relative to the first connecting member in a second direction opposite to the first direction so as to enable the pawl unit to slide past the ratchet teeth in order to dispose the front end portion of the second connecting member at a position coplanar with the first end portion of the first connecting member.

According to another aspect of the present invention, a furniture frame includes a support frame adapted to be supported on a ground surface, a first frame member disposed on the support frame, a second frame member disposed on the support frame and anteriorly of the first frame member, and a connecting device which includes first and second connecting members, a mounting plate and a pivotable linking plate unit. The first connecting member has a first end portion fixed to the first frame member, and a second end portion opposite to the first end portion and formed with a plurality of ratchet teeth. The second connecting member has a front end portion fixed to the second frame member, and a rear end portion pivoted to the second end portion of the first connecting member. The rear end portion is provided with a spring-loaded pawl unit. The mounting plate is disposed below the first and second connecting members and is fixed to the support frame. The linking plate unit has an upper end pivoted to the first end portion of the first connecting member, and a lower end pivoted to the mounting plate such that the first connecting member is movable forward and rearward relative to the mounting plate. The second frame member is pivotable relative to the first frame member in a first direction so as to enable the pawl unit to engage one of the ratchet teeth in order to retain the second frame member at a certain angular position relative to the first frame member. The second frame member is further pivotable relative to the first frame member in a second direction opposite to the first direction so as to enable the pawl unit to slide past the ratchet teeth in order to dispose the second frame member at a position coplanar with the first frame member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
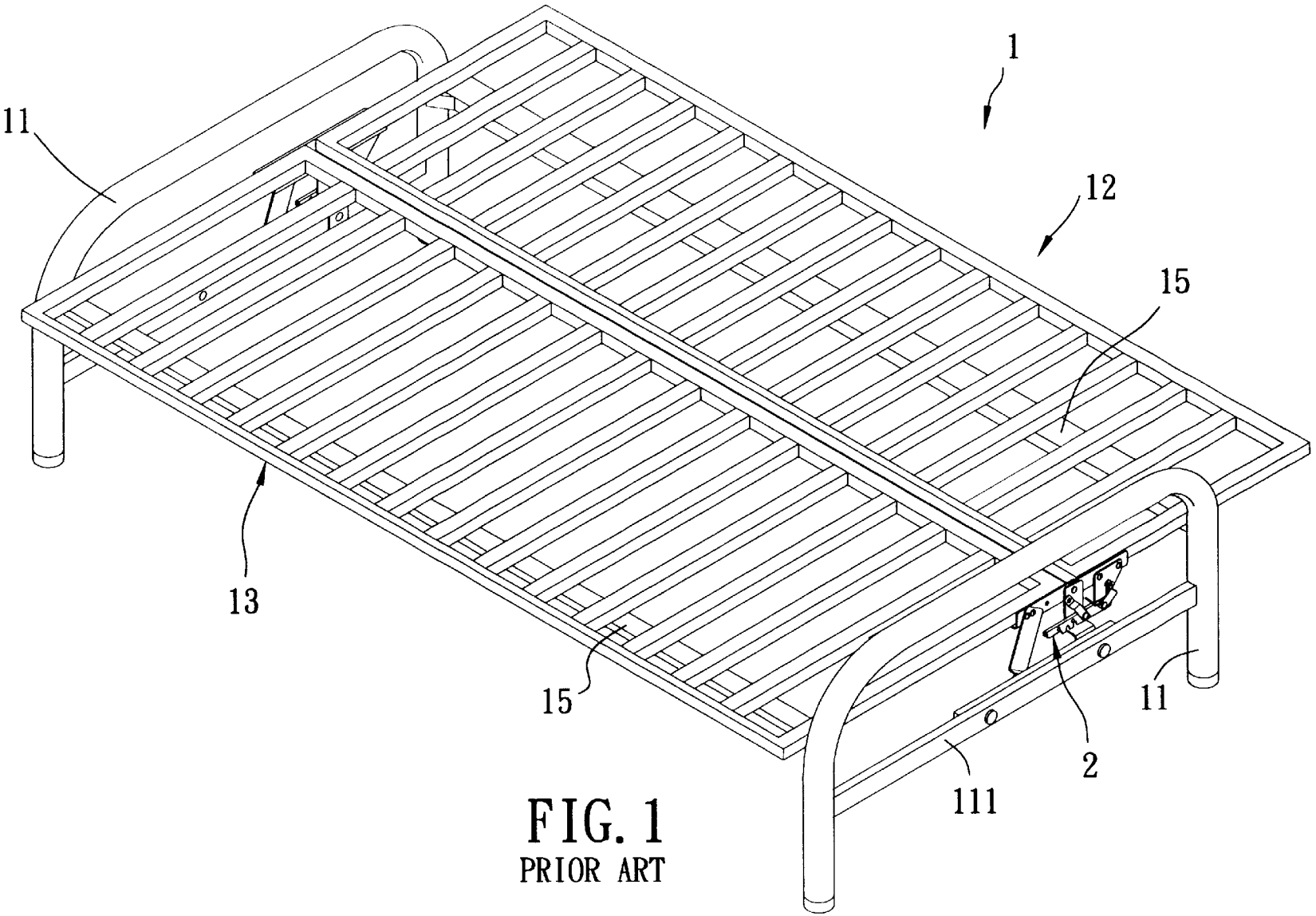
FIG. 1 PRIOR ART
FIG. 1 is perspective view illustrating a sofa bed that incorporates a conventional connecting device.
Figure 2:
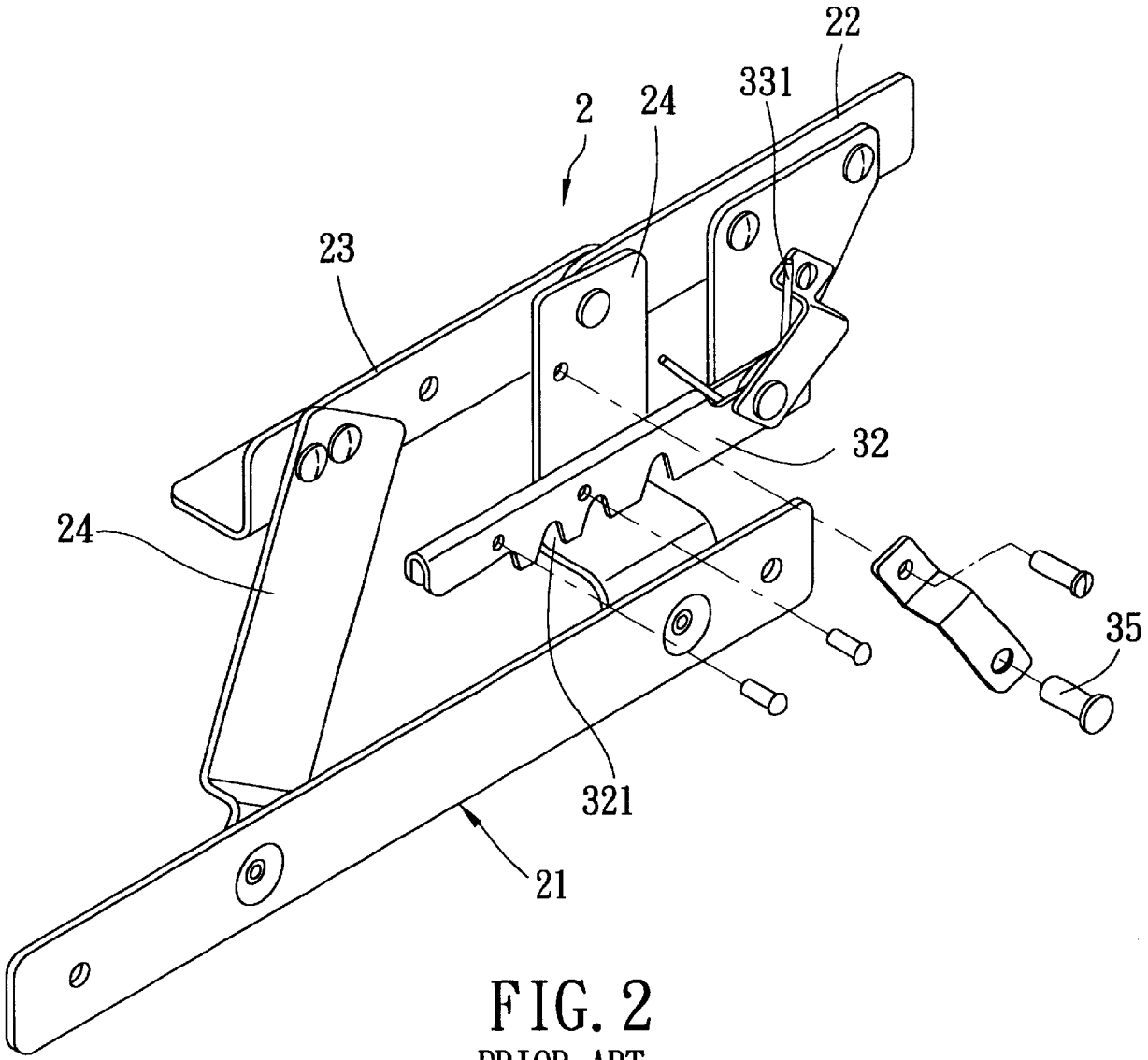
FIG. 2 PRIOR ART
FIG. 2 is a partly exploded, perspective view illustrating the conventional connecting device.
Figure 3:
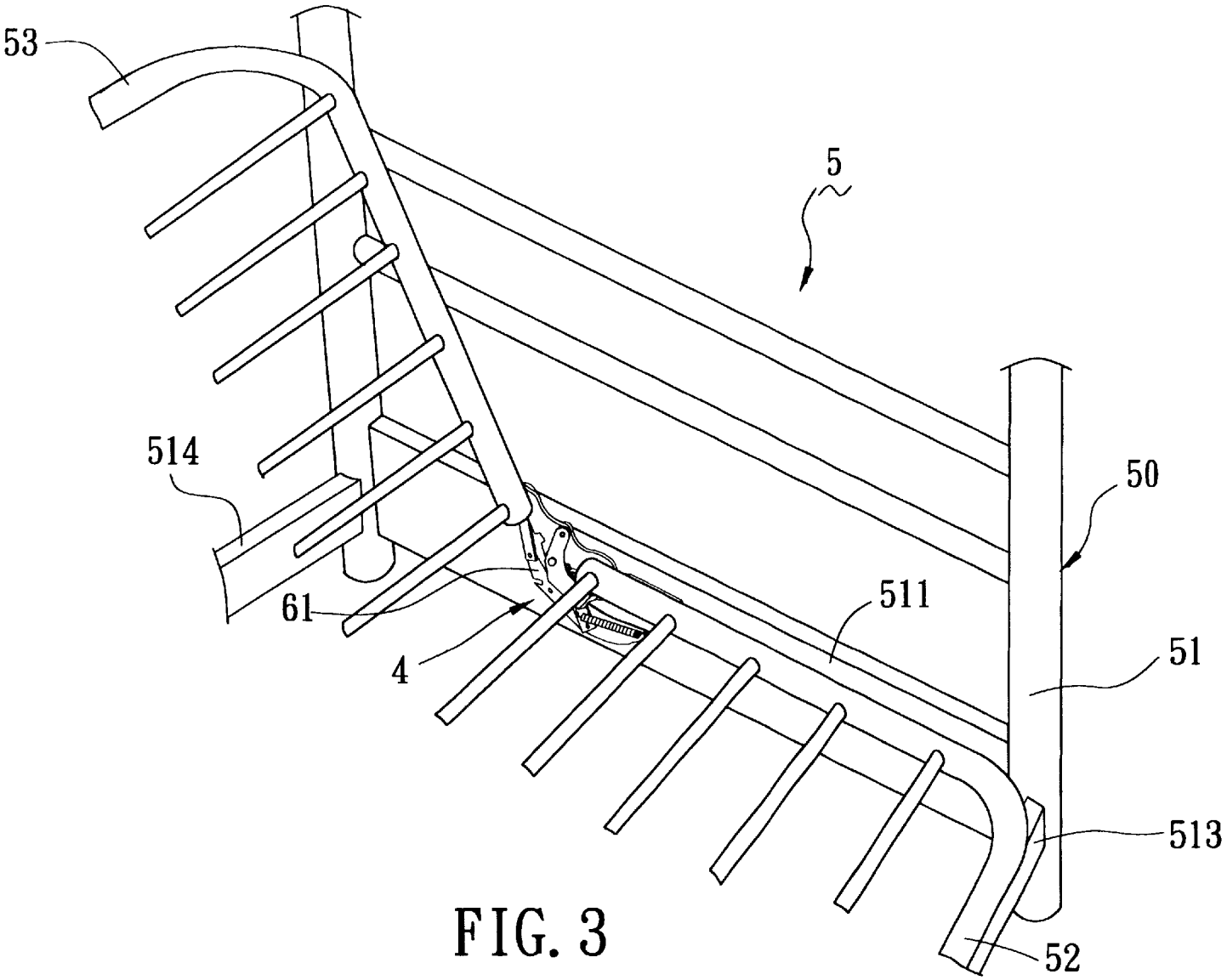
FIG. 3 is a fragmentary perspective view of a sofa bed that incorporates a preferred embodiment of the connecting device of the present invention.
Figure 4:
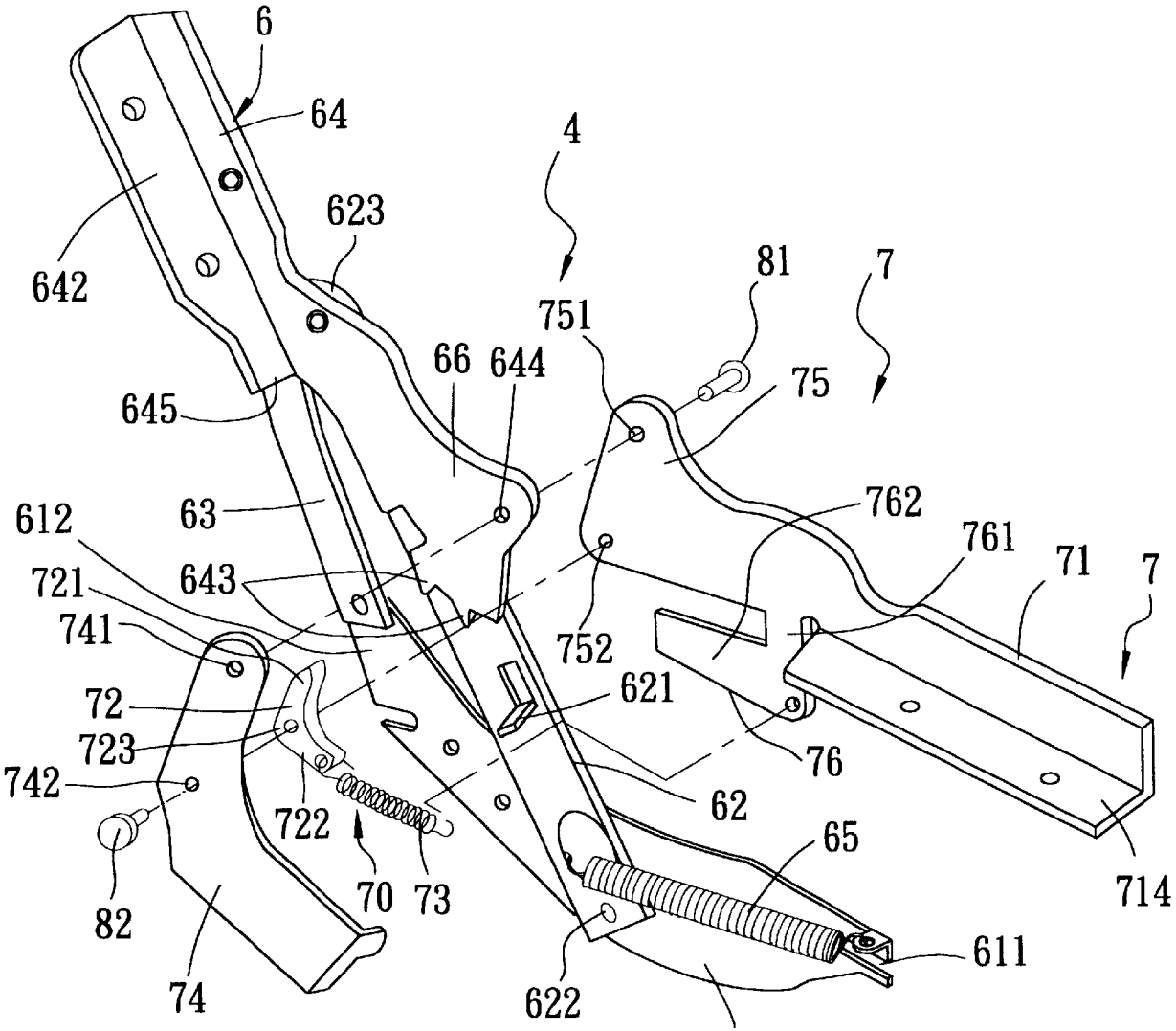
FIG. 4 is a partly exploded, perspective view of the connecting device of the preferred embodiment.

Referring to FIGS. 3 and 4, the preferred embodiment of the connecting device of the present invention is adapted to be used in a piece of furniture, such as a convertible sofa bed 5, which can serve as a sofa or a bed. The sofa bed 5 has a furniture frame which includes a support frame 50 having left and right leg frames 51 (only one is shown) adapted to be supported on a ground surface, and front and rear horizontal bar 513, 514 parallel to each other and interconnecting the leg frames 51. The sofa bed 5 further includes a backrest frame 53 disposed on the support frame 50, and a seat frame 52 disposed on the support frame 50 and anteriorly of the backrest frame 53. The seat frame 52 has left and right sides disposed adjacent to the leg frames 51, respectively, and front and rear ends. The backrest frame 53 also has left and right sides disposed adjacent to the leg frames 51, respectively, a front end disposed adjacent to the rear end of the seat frame 52, and a rear end. Each of the leg frames 51 has an inner side 511 which faces the seat frame 52 and the backrest frame 53 and which is attached with one connecting device 4 of the preferred embodiment for interconnecting the backrest frame 53 and the seat frame 52.

The connecting device 4 is shown to include a first connecting member 6, a second connecting member 7, a mounting plate 61, a pivotable linking plate unit which includes front and rear linking plates 62, 63, and a limiting plate 74.

The first connecting member 6 is formed as an elongated plate body, and has opposite first and second end portions 64, 66. The first end portion 64 is bent to have an L-shaped cross-section, and includes a fastening plate part 642 adapted to be fixed to the backrest frame 53. The second end portion 66 is formed with a pivot hole 644 proximate to an upper edge of the plate body, and at least two ratchet teeth 643 which are formed on and which are arranged along a lower edge of the plate body.

The second connecting member 7 includes an elongated plate body with opposite front and rear end portions 71,75. The front end portion 71 is bent to have an L-shaped cross-section, and has a fastening plate part 714 adapted to be fastened to the seat frame 52. The rear end portion 75 is formed with a pivot hole 751 proximate to an upper edge of the plate body of the second connecting member 7, and a mounting hole 752 proximate to a lower edge of the same. A first rivet 81 extends through the pivot holes 751, 644 for connecting the rear end portion 75 of the second connecting member 7 pivotally to the second end portion 66 of the first connecting member 6. The second connecting member 7 further has an L-shaped limiting arm 76 which projects. downwardly from an intermediate portion of the second connecting member 7, and which includes a first section 761 extending downwardly from the intermediate portion, and a second section 762 extending rearwardly from the first section 761. A spring-loaded pawl unit 70 is provided on the rear end portion 75 of the second connecting member 7. The pawl unit 70 includes a generally L-shaped pawl block 72 and a first extension spring 73. The pawl block 72 has an engaging end 721, a connecting end 722 opposite to the engaging end 721, and an intermediate pivot portion 723 extending between the engaging end 721 and the connecting end 722. The pivot portion 723 is mounted pivotally on the rear end portion 75 of the second connecting member 7 via a second rivet 82 which extends through the pivot portion 723 and the mounting hole 752 in the second connecting member 7. The first extension spring 73 has two opposite ends, one of which is hooked at the connecting end 722 of the pawl block 72, the other one of which is hooked at a lower end of the first section 761 of the limiting arm 76, for urging the engaging end 721 of the pawl block 72 to turn rearward.

The mounting plate 61 is formed as an elongated plate body with front and rear ends 611, 612, and is adapted to be fixed to the inner side 511 of a respective one of the leg frames 51. The mounting plate 61 is disposed below the first and second connecting members 6, 7, and is connected to the first connecting member 6 by means of the front and rear linking plates 62, 63. The front linking plate 62 has a lower end 622 pivoted to an intermediate portion of the mounting plate 61 between the front and rear ends 611, 612, and an upper end 623 pivoted to the first end portion 64 of the first connecting member 6. The rear linking plate 63 is disposed posteriorly of the front linking plate 62, and has a lower end pivoted to the rear end 612 of the mounting plate 61 and an upper end pivoted to the first end portion 64 of the first connecting-member 6. A second extension spring 65 has one end hooked on the front end 611 of the mounting plate 61, and an opposite end hooked on the front linking plate 62 at a position above the lower end 622 for urging the upper end 623 of the front linking plate 62 to move forward, thereby urging the first connecting member 6 to move forward relative to the mounting plate 61. The front linking plate 62 is formed with a stop projection 621 at an intermediate portion thereof above the second extension spring 65.

The limiting plate 74 is formed with two fastener holes 741, 742 which permit extension of the first and second rivets 81, 82, respectively, therethrough for securing the limiting plate 74 to the rear end portion 75 of the second connecting member 7. The pawl unit 70 is disposed between the plate body of the second connecting member 7 and the limiting plate 74, and is concealed by the limiting plate 74.

Figure 5:
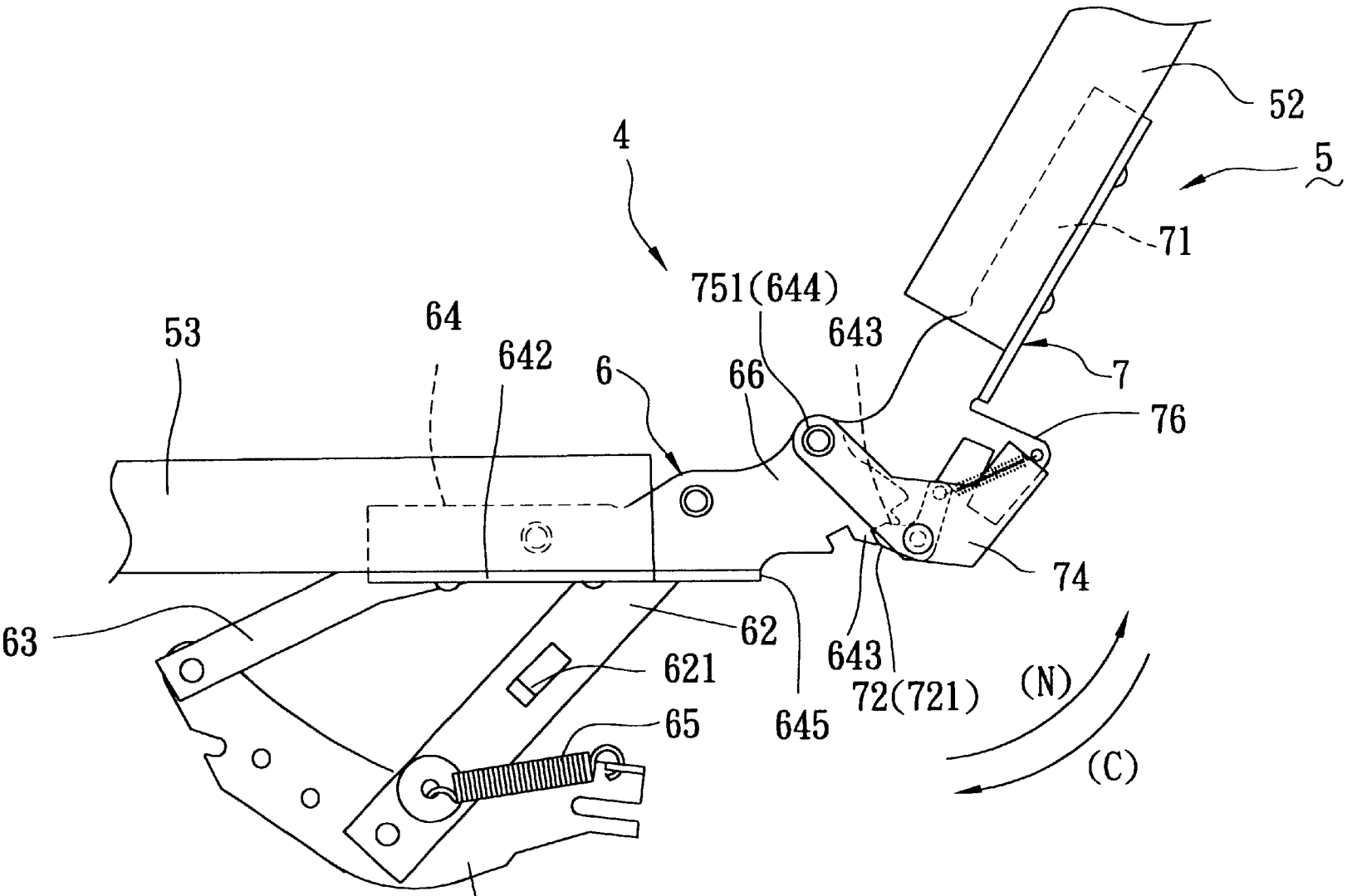
FIG. 5 is a side view of the connecting device of the preferred embodiment when it is operated for converting the sofa bed between a sofa and a bed.
Figure 6:
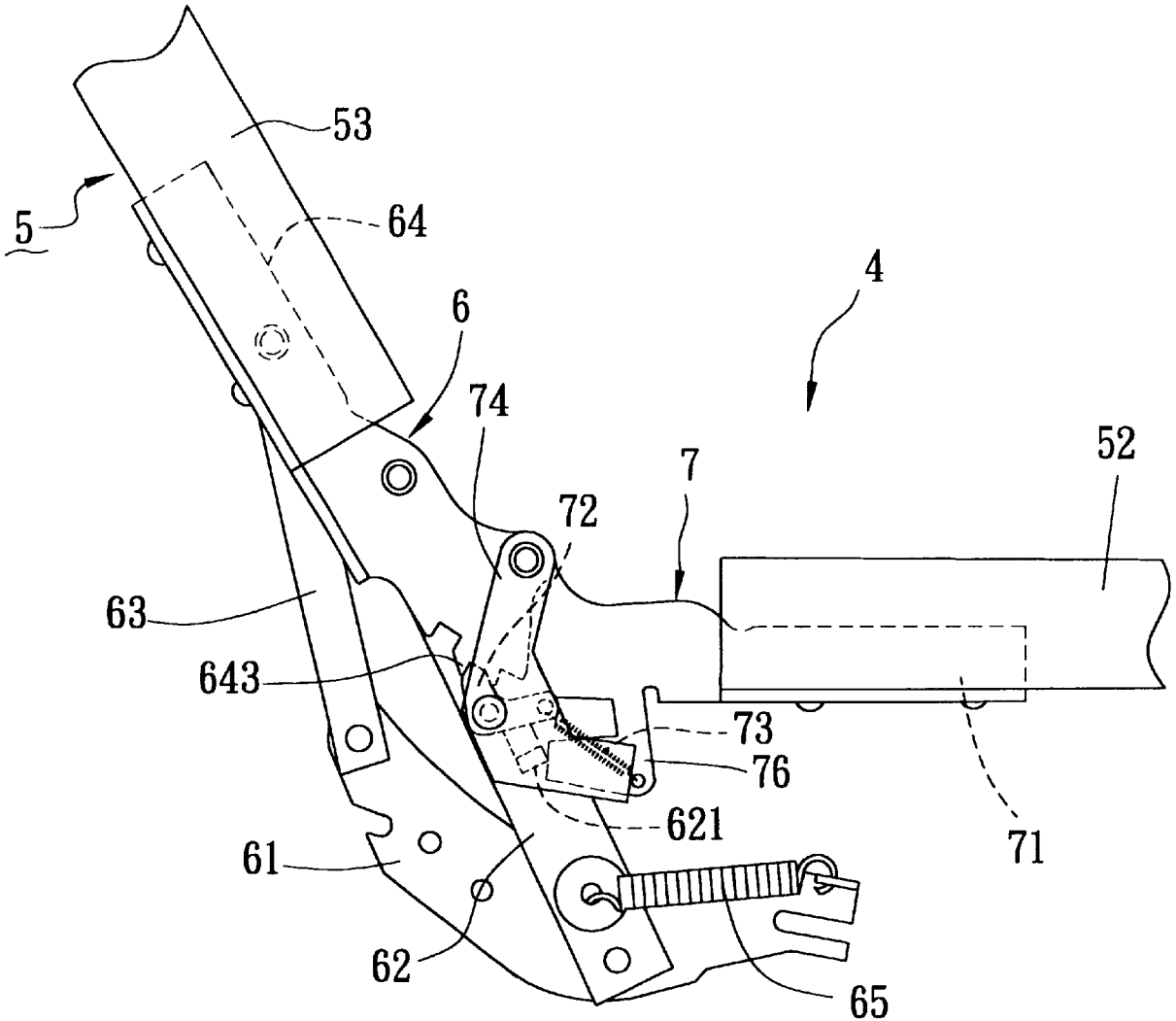
FIG. 6 is another side view of the preferred embodiment when the sofa bed is converted to a sofa.

Referring to FIGS. 5 and 6, when the sofa bed is to be used as a sofa, the seat member 52 is moved pivotally about a pivot. axis of the pivot holes 751, 644 relative to the backrest frame 53 in a first direction, i.e., a counterclockwise direction (N) shown in FIG. 5, so as to enable the engaging end 721 of the pawl block 72 to engage a selected one of the ratchet teeth 643. The second connecting member 7 is thus locked to the first connecting member 6, and is retained at a certain angular position relative to the first connecting member 6. Then, the seat member 52 is pushed rearward to result in rearward movement of the backrest frame 53 since the second connecting member 7 is locked to the first connecting member 6. This results in rearward turning of the upper ends of the linking plates 62, 63 relative to the mounting plate 61 and against biasing action of the second extension spring 65. When the limiting arm 76 on the second connecting member 7 abuts against the stop projection 621 on the front linking plate 62 during rearward movement of the backrest frame 53 together with the seat frame 52, the backrest frame 53 and the seat frame 52 are disposed at a first position shown in FIG. 6, in which the seat frame 52 extends along a horizontal plane, and in which the backrest frame 53 turns upward and is inclined relative to the seat frame 52. The sofa bed 5 can thus serve as a sofa at this time. It is noted that the weight of the backrest frame 53 is applied to the upper ends of the front and rear linking plates 62, 63 after the sofa bed is converted into a sofa, and can resist forward turning of the linking plates 62, 63 due to the biasing action of the second extension spring 65.

Figure 7:
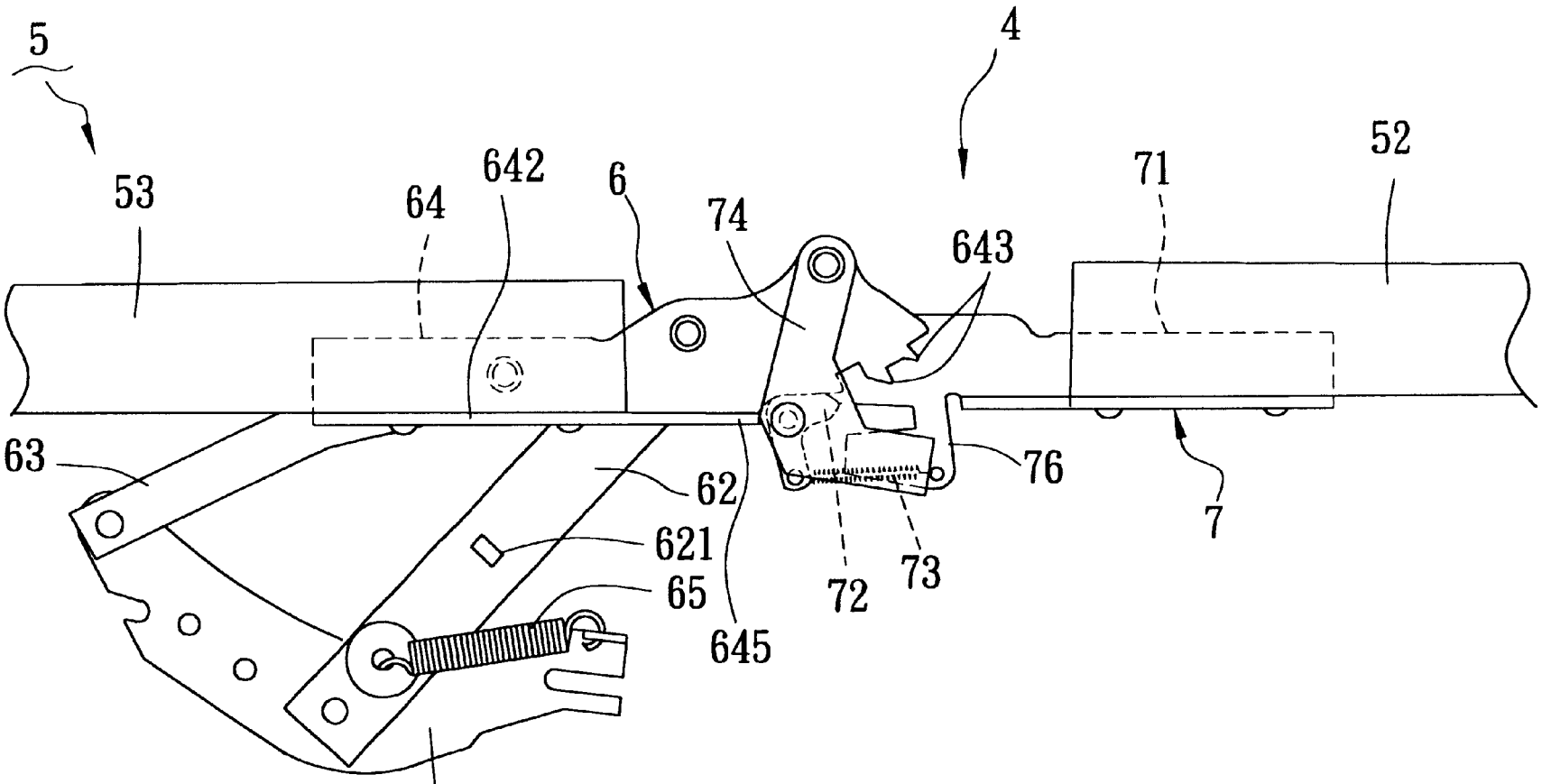
FIG. 7 is yet another side view of the preferred embodiment when the sofa bed is converted to a bed.

With further reference to FIG. 7, to convert the sofa bed from the sofa to a bed, the seat frame 52 is pulled forwardly, with the pawl block 72 engaging one of the ratchet teeth 643, to dispose the backrest frame 53 at a generally horizontal position, as shown in FIG. 5. Then, the seat frame 52 is lifted so as to disengage and remove the pawl block 72 from the ratchet teeth 643. Thereafter, the seat frame 52 is moved pivotally relative to the backrest frame 53 about the pivot axis of the pivot holes 751, 644 in an opposite second direction, 20 i.e., in a clockwise direction (C) shown in FIG. 5, so as to enable the pawl block 72 to slide past each of the ratchet teeth 643 in sequence, until the limiting plate 74 abuts against an abutment portion 645 formed on a front end of the fastening plate part 642 of the first connecting member 6. At this time, the backrest frame 53 and the seat frame 52 are disposed at a second position shown in FIG. 7, in which the backrest frame 53 is coplanar with the seat frame 52, and in which the backrest frame 53 and the seat frame 52 extend along a horizontal plane. The sofa bed 5 is thus converted into a bed at this time.

It has thus been shown that, because the backrest frame 53 and the seat frame 52 are moved rearward during operation for converting the sofa bed into a sofa, the sofa bed thus occupies a smaller amount of space when converted into a sofa, as compared with the aforementioned conventional sofa bed. Moreover, the position of the backrest frame 53 is adjustable by operating the seat frame 52, instead of operating the backrest frame 53. As such, the adjustment operation is easier to conduct.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A connecting device for a furniture frame having a support frame and first and second frame members disposed on the support frame and anteriorly of the first frame member, said connecting device comprising:

a first connecting member having a first end portion adapted to be fixed to the first frame member, and a second end portion opposite to said first end portion and formed with a plurality of ratchet teeth;

a second connecting member having a front end portion adapted to be fixed to the second frame member, and a rear end portion pivoted to said second end portion of the first connecting member, said rear end portion being provided with a spring-loaded pawl unit;

amounting plate disposed below said first and second connecting members and adapted to be fixed to the support frame; and a pivotable linking plate unit having an upper end pivoted to said first end portion of said first connecting member, and a lower end pivoted to said mounting plate such that said first connecting member is movable forward and rearward relative to said mounting plate;

said second connecting member being pivotable relative to said first connecting member in a first direction so as to enable said pawl unit to engage one of said ratchet teeth in order to retain said second connecting member at a certain angular position relative to said first connecting member;

said second connecting member being further pivotable relative to said first connecting member in a second direction opposite to the first direction so as to enable said pawl unit to slide past said ratchet teeth in order to dispose said front end portion of said second connecting member at a position coplanar with said first end portion of said first connecting member.

2. The connecting device as claimed in claim 1, wherein said mounting plate has front and rear ends and an intermediate portion between said front and rear ends, said linking plate unit including a front linking plate having an upper end pivoted to said first end portion of said first connecting member and a lower end pivoted to said intermediate portion of said mounting plate.

3. The connecting device as claimed in claim 2, further comprising an extension spring having a first end connected to said front end of said mounting plate and a second end opposite to said first end and connected to said front linking plate for urging said upper end of said front linking plate forward.

4. The connecting device as claimed in claim 2, wherein said linking plate unit further includes a rear linking plate disposed posteriorly of said front linking plate and having an upper end pivoted to said first end portion of said first connecting member and a lower end pivoted to said rear end of said mounting plate.

5. The connecting device as claimed in claim 2, wherein said second connecting member has an intermediate portion between said front and rear end portions, and a limiting arm projecting downwardly from said intermediate portion, said front linking plate being formed with a stop projection which abuts against said limiting arm when said first and second connecting members are moved rearward with said pawl unit engaging said ratchet teeth.

6. The connecting device as claimed in claim 5, wherein said limiting arm is L-shaped, and has a first section extending downwardly from said intermediate portion of said second connecting member, and a second section extending rearwardly from said first section.

7. The connecting device as claimed in claim 5, wherein said spring-loaded pawl unit includes a pawl block having an engaging end for engaging said ratchet teeth, a connecting end opposite to said engaging end, and a pivot portion extending between said engaging end and said connecting end and mounted pivotally on said rear end portion of said second connecting member, said pawl unit further including an extension spring extending between said limiting arm and said connecting end of said pawl block for urging said engaging end to turn rearward.

8. The connecting device as claimed in claim 7, wherein said pawl block is L-shaped.

9. The connecting device as claimed in claim 1, further comprising a limiting plate secured to said rear end portion of said second connecting member, said first connecting member having an abutment portion which abuts against said limiting plate when said front end portion of second connecting member is coplanar with said first end portion of said first connecting member.

10. A furniture frame comprising:

a support frame adapted to be supported on a ground surface;

a first frame member disposed on said support frame;

a second frame member disposed on said support frame and anteriorly of said first frame member; and a connecting device which includes:

a first connecting member having a first end portion fixed to said first frame member, and a second end portion opposite to said first end portion and formed with a plurality of ratchet teeth;

a second connecting member having a front end portion fixed to said second frame member, and a rear end portion pivoted to said second end portion of said first connecting member, said rear end portion being provided with a spring-loaded pawl unit;

a mounting plate disposed below said first and second connecting members and fixed to said support frame; and a pivotable linking plate unit having an upper end pivoted to said first end portion of said first connecting member, and a lower end pivoted to said mounting plate such that said first connecting member is movable forward and rearward relative to said mounting plate;

said second frame member being pivotable relative to said first frame member in a first direction so as to enable said pawl unit to engage one of said ratchet teeth in order to retain said second frame member at a certain angular position relative to said first frame member;

said second frame member being further pivotable relative to said first frame member in a second direction opposite to the first direction so as to enable said pawl unit to slide past said ratchet teeth in order to dispose said second frame member at a position coplanar with said first frame member.

* * * * *